US007367659B2

(12) United States Patent
Yazawa

(10) Patent No.: US 7,367,659 B2
(45) Date of Patent: May 6, 2008

(54) INK JET PRINTER ALTERNATELY UTILIZING A PAIR OF IN CARTRIDGES

(75) Inventor: Hiroaki Yazawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 283 days.

(21) Appl. No.: 11/211,629

(22) Filed: Aug. 26, 2005

(65) Prior Publication Data

US 2006/0044370 A1 Mar. 2, 2006

(30) Foreign Application Priority Data

Aug. 27, 2004 (JP) ..... 2004-248493

(51) Int. Cl.
*B41J 2/175* (2006.01)
*B43K 23/02* (2006.01)

(52) U.S. Cl. ..... 347/85; 401/131

(58) Field of Classification Search ..... 347/85, 347/139 R; 401/131
See application file for complete search history.

(56) References Cited

U.S. PATENT DOCUMENTS 4,417,258 A * 11/1983 Tribolet et al. ..... 346/139 R
5,877,793 A * 3/1999 Erickson ..... 347/85
6,368,002 B1 * 4/2002 Saund et al. ..... 401/131
7,090,341 B1 * 8/2006 Miyazawa ..... 347/85

FOREIGN PATENT DOCUMENTS

| | | |
|---|---|---|
| JP | 8281928 | * 10/1996 |
| JP | 2002-355989 | 12/2002 |
| JP | 2002355989 | * 12/2002 |

* cited by examiner

*Primary Examiner*—Manish S. Shah
*Assistant Examiner*—Carlos A. Martinez, Jr.
(74) *Attorney, Agent, or Firm*—Banner & Witcoff, Ltd.

(57) ABSTRACT

An ink jet printer is provided with a carriage, a pair of ink cartridges, an ink jet head, an ink tank, and an ink replenishment device. The pair of ink cartridges stores ink of same color. The carriage alternately supports each the ink cartridge. The ink jet head is supported by the carriage. The ink jet head discharges ink supplied from the ink cartridge currently being supported by the carriage. The ink tank stores the ink of the predetermined color. The ink replenishment device replenishes the ink cartridge currently not being supported by the carriage with the ink from the ink tank.

13 Claims, 15 Drawing Sheets

INK JET PRINTER ALTERNATELY UTILIZING A PAIR OF IN CARTRIDGES

CROSS-REFERENCE TO RELATED APPLICATION

This application claims priority to Japanese Patent Application No. 2004-248493, filed on Aug. 27, 2004, the contents of which are hereby incorporated by reference into the present application.

BACKGROUND OF THE INVENTION

1. Field of the Invention

The present invention relates to an ink jet printer.

2. Description of the Related Art

Ink jet printers are well known. Some types of ink jet printer are provided with a carriage that moves along a rail. The carriage supports an ink cartridge that stores ink. The carriage also supports an ink jet head. Ink is supplied to the ink jet head from the ink cartridge mounted on the carriage. The ink jet head discharges the ink that has been supplied from the ink cartridge. The ink jet printer discharges the ink from the ink jet head toward a print medium while the carriage is moving. Printing can thus be performed on the entirety of the print medium.

Some ink jet printers are provided with an ink tank for storing ink. The ink tank is fixed to a printer main body. An ink jet printer provided with an ink tan is taught in, for example, Japanese Patent Application Publication No. 2002-355989. In this printers when the amount of ink runs low in the ink cartridge mounted on the carriage, the carriage is moved to a position close to the ink tank, and the ink cartridge is then replenished with ink from the ink tank.

In the case of the conventional ink jet printer described above, the carriage must be halted next to the ink tank while the ink cartridge is being replenished. Consequently, printing operation cannot be performed while the ink cartridge is being replenished. In the aforementioned conventional ink jet printer, the printing operation is halted for a long time.

The present invention has taken the aforementioned circumstances into consideration, and aims to provide an ink jet printer in which the printing operation is not halted for a long time.

BRIEF SUMMARY OF THE INVENTION

An ink jet printer taught in the present specification is provided with a carriage, a pair of ink cartridges, an ink jet head, an ink tank, and an ink replenishment device. The pair of ink cartridges store ink of same color respectively. The carriage alternately supports one of the pair of ink cartridges. The other of the pair of ink ridges may be supported by a printer main body. The ink jet head is supported by the carriage. The ink jet head discharges ink supplied from the ink cartridge currently being supported by the carriage. The ink tank stores ink of the same color. The ink replenishment device replenishes the other of the pair of the ink cartridge currently not being supported by the carriage with the ink from the ink tank.

With this ink jet printer, when the amount of ink runs low in the ink cartridge being supported by the carriage, this first ink cartridge can be removed from the carriage, and the second ink cartridge can be mounted on the carriage. The first ink cartridge removed from the carriage is replenished by the ink replenishment device. Since the second ink cartridge is mounted on the carriage, the carriage can move and execute tie printing operation while the ink in the first ink cartridge is being replenished.

When the amount of ink runs low in the second ink cartridge that is currently being supported by the carriage, the second ink cartridge can be removed from the carriage, and the first ink cartridge, which has had the ink therein replenished, can be mounted on the carriage. The ink in the second ink cartridge can be replenished after the second ink cartridge has been removed from the carriage. Since the first ink cartridge is now mounted on the carriage, the carriage can move and execute the printing operation while the ink in the second ink cartridge is being replenished.

The ink jet printer can perform printing operation by alternately using one of the pair of ink cartridges. As a result, the printing operation can be performed while the ink in the ink cartridges is being replenished. In this ink jet printer, it is possible to prevent the printing operation from being halted for a long time while the ink cartridge is being replenished with ink from the ink tank.

BRIEF DESCRIPTION OF THE DRAWINGS

FIG. 9(*b*) shows a state after the ink cartridge has been exchanged.

FIG. 10(*b*) shows a state where the ink cartridge has been transferred from a first position to a second position. FIG. 10(*c*) shows a state where a second support member has been lowered.

DETAILED DESCRIPTION OF THE INVENTION

First Embodiment

Figure 1:
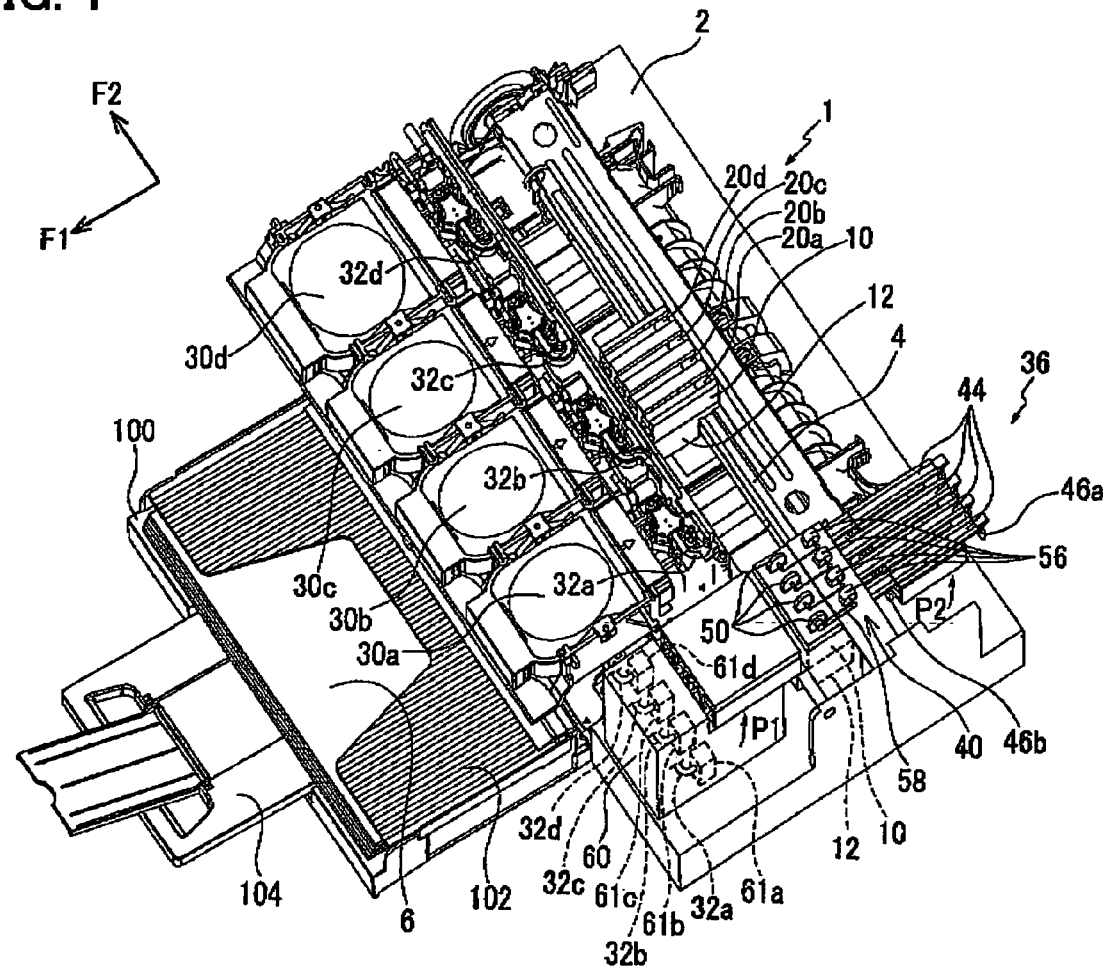
FIG. 1 shows a perspective view of an ink jet printer of a first embodiment.

FIG. 1 shows a perspective view of an ink jet printer 1 of the first embodiment. Further, the direction of the arrow F1 n FIG. 1 is an anterior side of the printer 1.

The ink jet printer 1 has a casing 2. In FIG. 1, a cover of the casing 2 has been omitted so that each of the devices within the casing 2 can be shown. In FIG. 1, a base of the casing 2 is shown. A guide rail 4 is provided within the casing 2. The guide rail 4 extends in a direction (the direction of the anew F2) perpendicular to the feeding direction of printing paper 6 (the direction of the arrow F1). Although this is not shown in FIG. 1, a guide shaft 5 (shown in FIG. 2) extends at an anterior side of the guide rail 4. The guide shaft 5 is parallel with the guide rail 4. The guide rail 4 and the guide shaft 5 support a carriage 10.

The carriage 10 is engaged with the guide rail 4 and the guide shaft 5 in a manner allowing sliding. The carriage 10 can be moved along tie guide rail 4 and the guide shaft 5. The carriage 10 is connected with a carriage motor 244 (not shown in FIG. 1, but shown in FIG. 11). A belt mechanism (not shown) is provided between the carriage 10 and the carriage motor 244. When the carriage motor 244 is driven, driving force is applied to the carriage 10 via the belt mechanism. The carriage 10 therefore moves along tie guide rail 4. In FIG. 1, the carriage 10 is shown by a broken line in a position furthest to the right (at the side furthest from the direction of the arrow F2). When the carriage 10 is in this position, an action (to be described) for exchanging an ink cartridge is performed.

Four ink cartridges 20*a*, 20*b*, 20*c*, and 20*d* are supported by the carriage 10. Each of the ink cartridges 20*a* to 20*d* can be attached to or removed from the carriage 10. The ink cartridge 20*a* stores black ink. The ink cartridge 20*b* stores cyan ink. The ink cartridge 20*c* stores yellow ink. The ink cartridge 20*d* stores magenta ink.

The printer 1 of the present embodiment can be provided with a black ink cartridge 22*a* (not shown in FIG. 1, but shown in FIG. 9 and FIG. 10) in addition to the ink cartridge 20*a*. That is, there are two ink cartridges for storing black ink. The ink cartridge 22*a*, which is not currently being supported by the carriage 10, is located in an ink cartridge exchanging device 36 (to be described). The manner in which the pair of ink cartridges 20*a* and 22*a* are used will be described in detail later. Similarly, the printer 1 has a pair of ink cartridges 20*b* and 22*b* (22*b* is not shown) that store cyan ink, a pair of ink cartridges 20*c* and 22*c* (22*c* is not shown) that store yellow ink, and a pair of ink cartridges 20*d* and 22*d* (22*d* is not shown) that store magenta ink.

The carriage 10 supports an ink jet head 12. The ink jet head 12 is fixed to a lower face of the carriage 10, and a plurality of nozzles (not shown) are formed in a lower face of the ink jet head 12. The ink jet head 12 draws in ink from the ink cartridges 20*a* to 20*d*, and discharges this ink from the nozzles. The printer 1 of the present embodiment discharges ink from the ink jet head 12 onto the printing paper 6 while the cartridge 10 is moving in a left-right direction. That is, the printer 1 of the present embodiment is a serial type printer.

Four ink tanks 30*a*, 30*b*, 30*c*, and 30*d* are fixed in a removable manner to the base of the casing 2. The ink tank 30*a* stores black ink. The ink tank 30*b* stores cyan ink. The ink tank 30*c* stores yellow ink. The ink tank 30*d* stores magenta ink. The ink tank 30*a* can store more black ink than the ink cartridge 20*a* (22*a*). Similarly, the ink tanks 30*b* to 30*d* can store more ink than the ink cartridges 20*b* to 20*d* (22*b* to 22*d*).

One end of a tube 32*a* is connected with the ink tank 30*a*. The other end of the tube 32*a* is connected with a pump 61*a* of the ink cartridge exchanging device 36. Further, one end of a tube 32*b* is connected with the ink tank 30*b*. The other end of the tube 32*b* is connected with a pump 61*b*. One end of a tube 32*c* is connected with the ink tank 30*c*. The other end of the tube 32*c* is connected with a pump 61*c*. One end of a tube 32*d* is connected with the ink tank 30*d*. The other end of the tube 32*d* is connected with a pump 61*d*.

A paper feed tray 100 is disposed at the anterior of the base of the casing 2. The paper feed tray 100 is disposed at the exterior of the casing 2. A paper discharge tray 102 is disposed above the paper feed tray 100, this paper discharge tray 102 receiving the printing paper 6 that has been printed and discharged. A plurality of sheets of printing paper 6 are stacked between the paper feed tray 100 and the paper discharge tray 102. A reserve tray 104 is disposed at the anterior of the paper feed tray 100, this reserve tray 104 receiving printing paper 6 so large that it projects from the paper discharge tray 102.

The ink cartridge exchanging device 36 is provided. Below, the ink cartridge exchanging device 36 will be termed simply 'exchanging device 36'. The exchanging device 36 is provided with a transferring device 40 and an ink replenishment device 60, etc.

The transferring device 40 transfers the ink cartridges 20*a* to 20*d* (22*a* to 22*d*), thus removing the ink cartridges 20*a* to 20*d* (22*a* to 22*d*) from the carriage 10, and attaching the ink cartridges 20*a* to 20*d* (22*a* to 22*d*) to the carriage 10.

The ink replenishment device 60 replenishes the removed ink cartridges 20*a* to 20*d* (22*a* to 22*d*) with ink from the ink tanks 30*a* to 30*d*.

The configuration of the transferring device 40 and the ink replenishment device 60 will be described in detail below.

Figure 2:
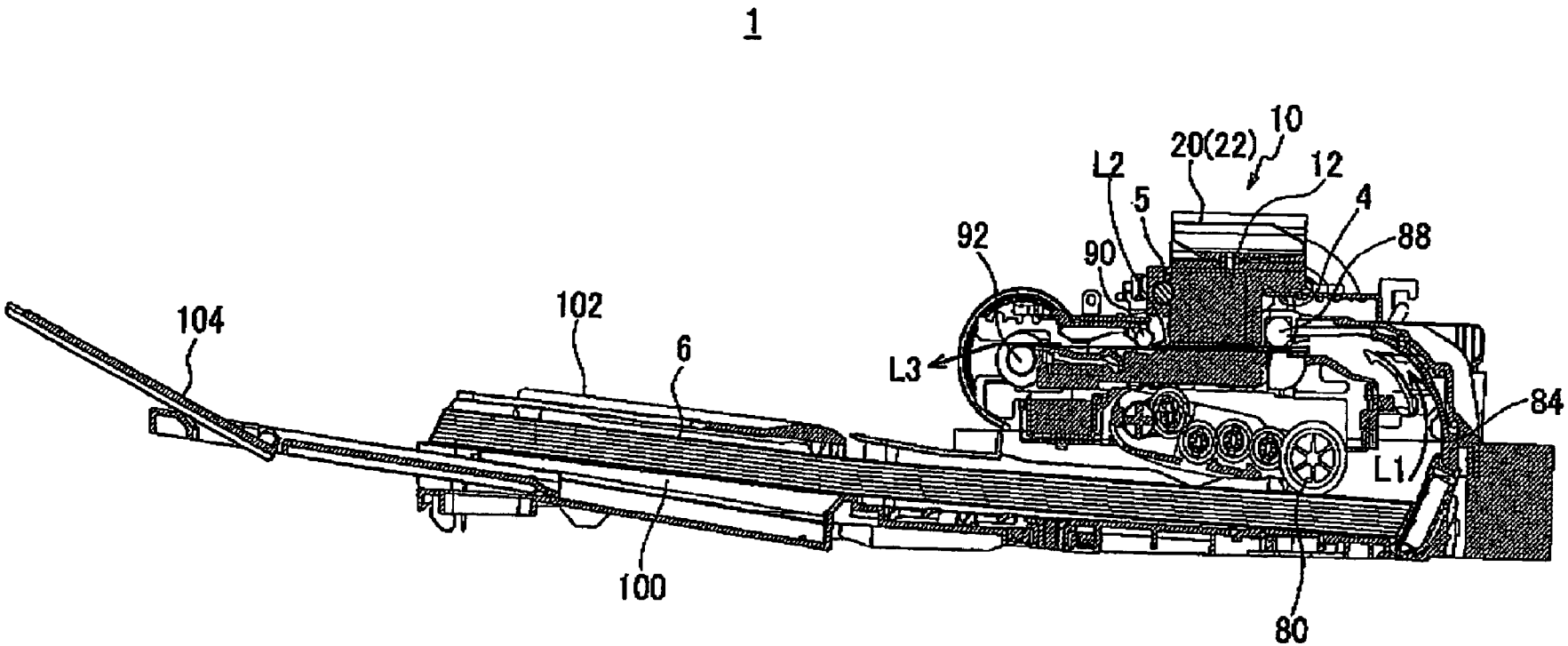
FIG. 2 shows a longitudinal sectional view of the ink jet printer.

Next, the method in which the printing paper 6 is transferred will be described with reference to FIG. 2. FIG. 2 shows a longitudinal sectional view of the printer 1. FIG. 2 shows a state where the ink tanks 30*a* to 30*d* have been removed. The ink tanks 30*a* to 30*d* are disposed at the left side of the age 10 and are above the arrow L3.

As shown in FIG. 2, a plurality of sheets of printing paper 6 are stacked above the paper feed tray 100. A feeding roller 80 makes contact with an uppermost sheet of the printing paper 6. When the feeding roller 80 rotates in a counter-clockwise direction, the uppermost printing paper 6 is transferred along a rail 84 (in the direction of the arrow L1). The printing paper 6 that has been moved in the direction of the arrow L1 makes contact with a lower edge of a resist roller 88. The resist roller 88 rotates in a clockwise direction, thereby positioning (see arrow L2) the printing paper 6 opposite the lower face (i.e. the nozzle face) of the ink jet head 12. In this state, ink is discharged from the ink jet head 12 onto the printing paper 6, and the printing paper 6 is thus printed. The ink is discharged from the ink jet head 12 while the carriage 10 is moving along the guide rail 4 and the guide shaft 5. Printing can thus be performed across the entire widthwise range of the printing paper 6 (the direction perpendicular to the plane of the page of FIG. 2). The printing paper 6 that has been printed makes contact with a pinch roller 90. The pinch roller 90 does not make contact with a driving source, but is instead driven by its contact with the printing paper 6. The printing paper 6 is transferred (see arrow L3) by a discharge roller 92 onto the paper discharge tray 102.

Figure 11:
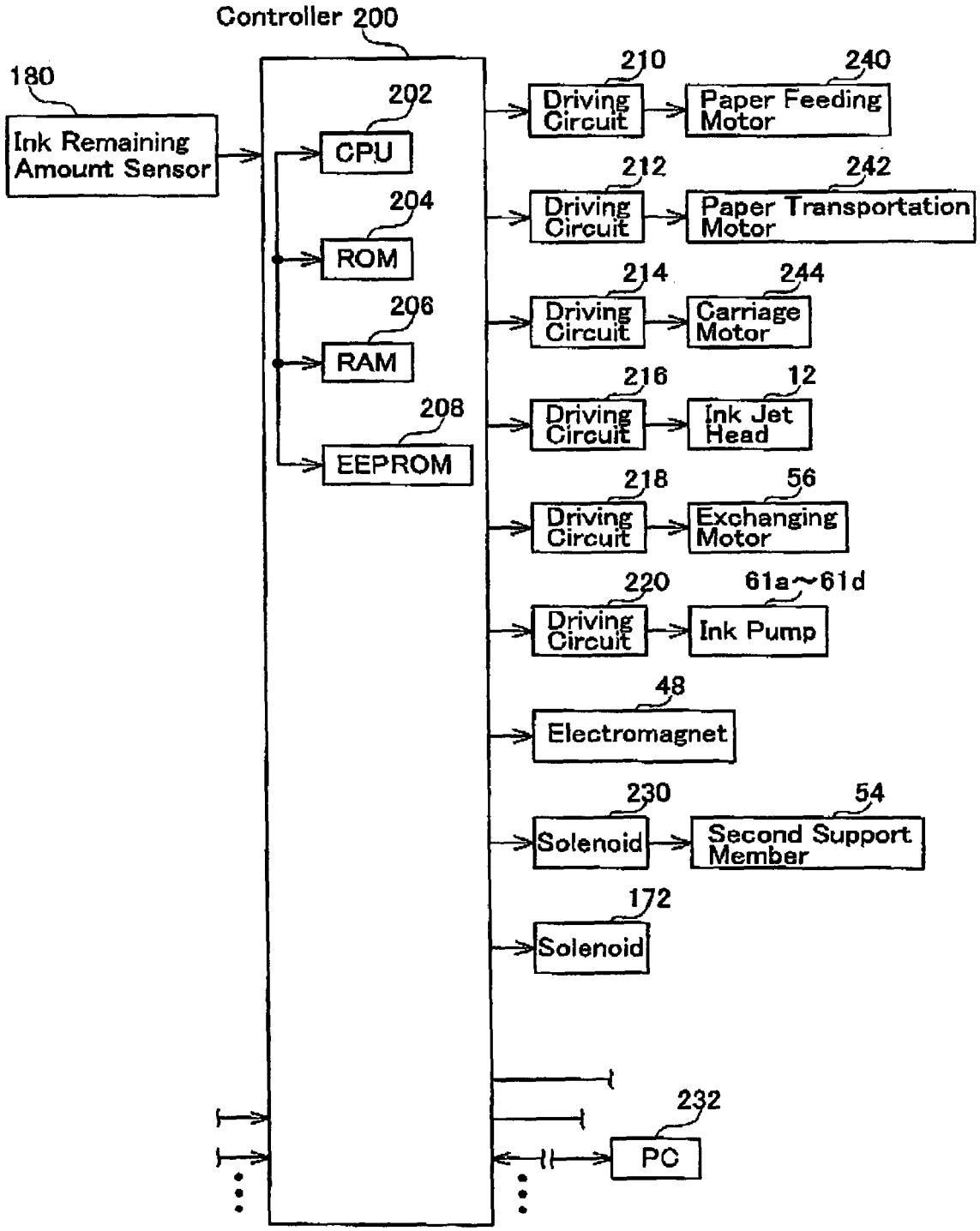
FIG. 11 shows a control configuration of the ink jet printer.

The feeding roller 80 is driven by a paper feeding motor 240 (see FIG. 11). The remaining rollers (the resist roller 88 and the discharge roller 92) are driven by a paper transportation motor 242 (see FIG. 11).

Next, the configuration of the ink cartridge 20*a*, etc. will be described in detail with reference to FIGS. 3 to 5. Each of the ink cartridges 20*a* to 20*d* and 22*a* to 22*d* has identical configuration. Here, the configuration of the ink cartridge 20*a* will be described.

Figure 3:
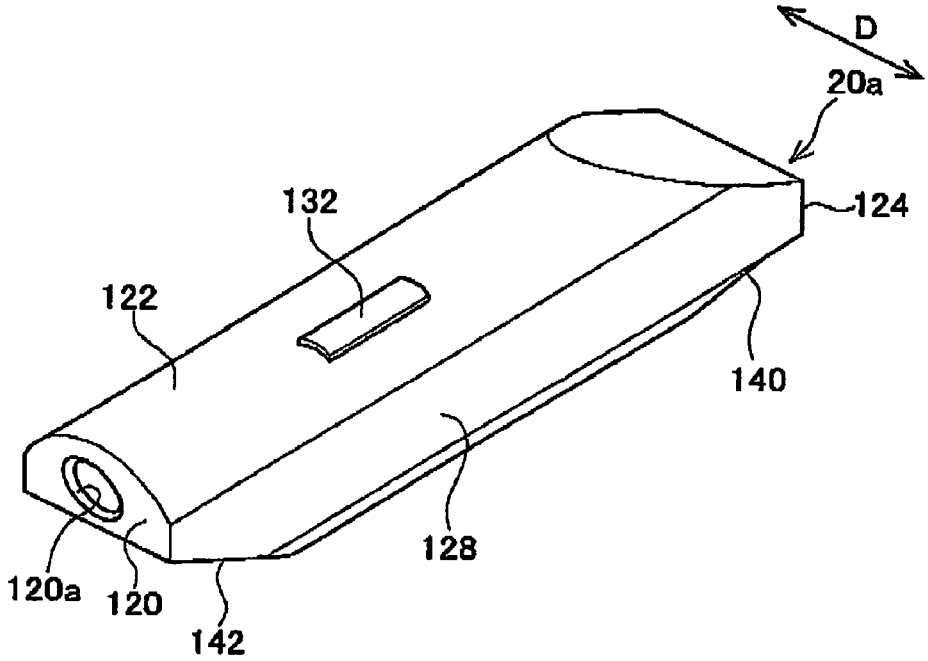
FIG. 3 shows a perspective view of an ink cartridge viewed obliquely from above.

FIG. 3 shows a perspective view of the ink cartridge 20*a* viewed obliquely from above. FIG. 4 shows a perspective view of the ink cartridge 20*a* viewed obliquely from below. FIG. 5 shows a longitudinal sectional view of the ink cartridge 20*a*.

The ink cartridge 20*a* is substantially box shaped. A replenishment hole 120*a* for replenishing the ink is formed in an anterior face 120 of the ink cartridge 20*a*. The anterior face 120 forms a face at the anterior side when the ink cartridge 20*a* has been moved from the carriage 10 to a first position P1 (to be described. See FIG. 9), and when the ink cartridge 20*a* has been moved to the carriage 10 from a second position P2 (to be described. See FIG. 9). As is clear from FIG. 5, a cap 150 is provided within the replenishment hole 120*a*. The cap 150 is energized towards the replenishment hole 120*a* by an energizing member 152. As long as pressure is not applied to the cap 150 from the exterior of the replenishment hole 120*a*, the cap 150 closes this replenishment hole 120*a*. A hole 150*a* that extends in a left-right direction is formed within the cap 150. The hole 150*a* bends downwards part-way along its length, and opens onto a side face of the cap 150. The hole 150*a* passes through a left face and the side face of the cap 150.

A central part, relative to the left-right direction (the direction of the arrow D in FIG. 3 and FIG. 4), of an upper face 122 of the ink cartridge 20*a* rises upwards. A metal plate 132 is fixed to this central part. The reference numbers 128 and 130 refer to side faces.

A base face 126 of the ink cadge 20*a* has a flat part 126*a* and a groove 126*b*. A shutter 136 fits, in a manner allowing sliding, into the groove 126*b*. The groove 126*b* grows deeper towards a posterior face 124. This shape is shown in FIG. 5. The deeper portion of the groove 126*b* is covered by the part 126*a*, thus forming a space 126*c* between the part 126*a* and a base face of the groove 126*b*. The space 126*c* is greater than the shutter 136. When the shutter 136 moves towards the right from the state shown in FIG. 5, the shutter 136 is housed within the space 126*c*. A through hole 126*d* is formed in a base face of the groove 126*b*. The shutter 136 opens and closes this through hole 126*d*. The through hole 126*d* is open when the shutter 136 is housed within the space 126*c*. In this state, the ink jet head 12 can use the ink of the ink cartridge 20*a*. Further, the ink cartridge 20*a* is provided with a spring member (not shown) for energizing the shutter 136 in the closed direction. The shutter 136 is closed as long as there is no force applied thereto that opposes the spring force. Moreover, a small groove 126*e* that is provided with a base is formed in a base face of the groove 126*b*.

Figure 4:
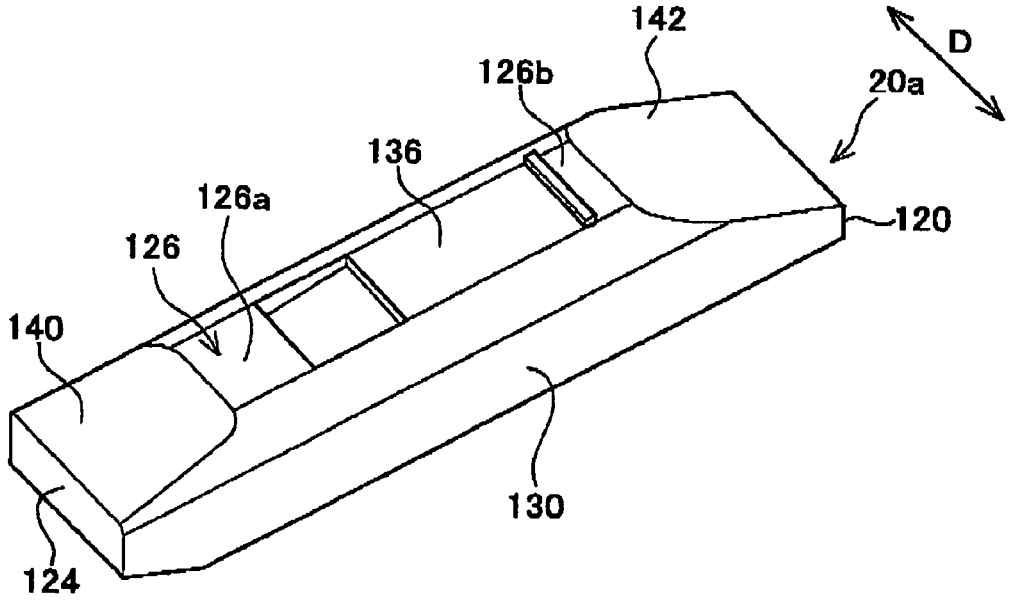
FIG. 4 shows a perspective view of the ink cartridge viewed obliquely from below.
Figure 5:
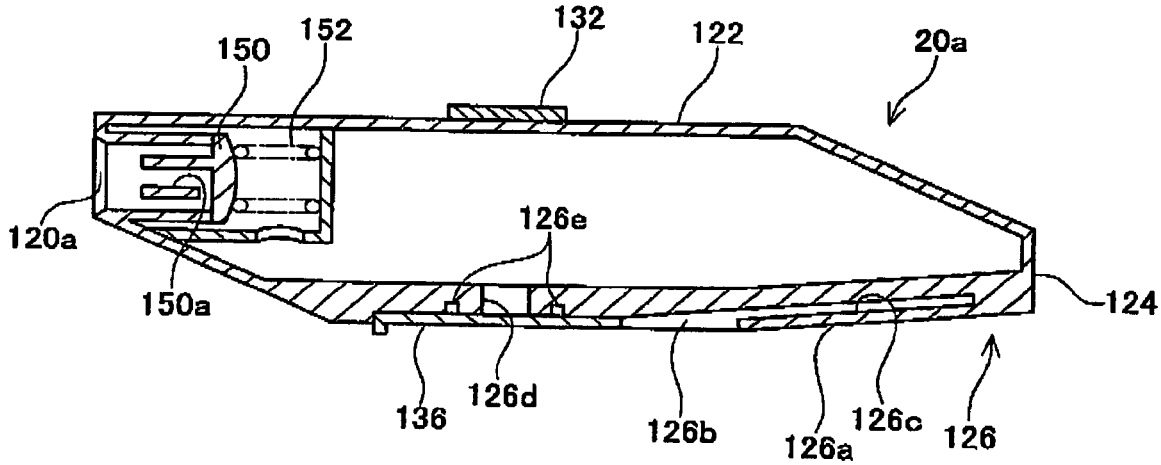
FIG. 5 shows a longitudinal sectional view of the ink cartridge.

As shown in FIG. 3 and FIG. 4, an inclined plane 140 is formed between the base face 126 and the posterior face 124. Further, an inclined plane 142 is formed between the anterior face 120 and the base face 126. The inclined planes 140 and 142 help the ink cartridge 20*a* move smoothly.

Figure 6:
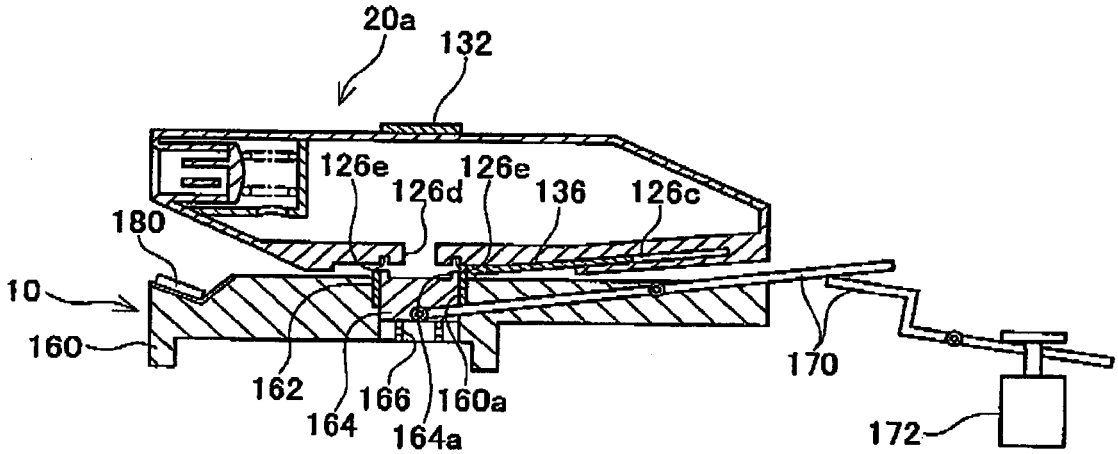
FIG. 6 shows a state before the ink cartridge has been mounted on a carriage.
Figure 7:
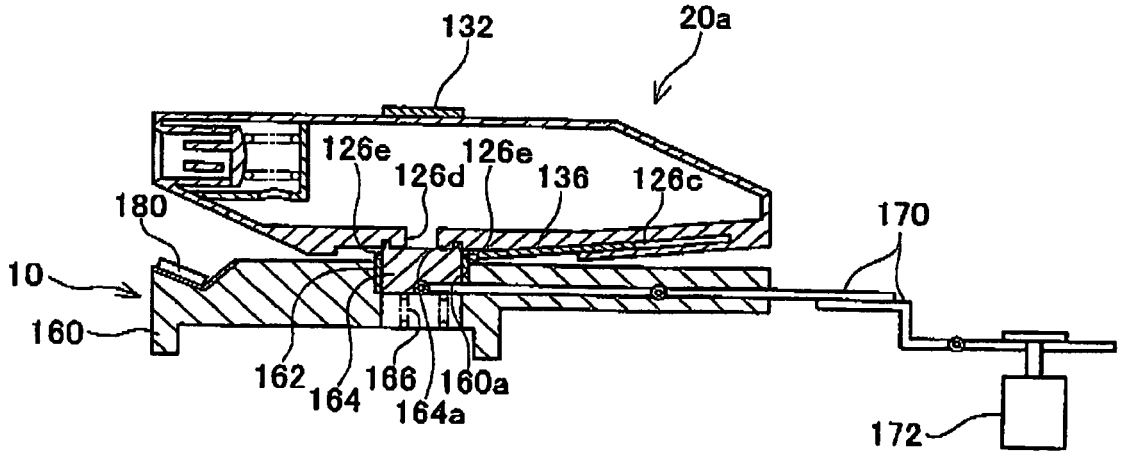
FIG. 7 shows a state after the ink cartridge has been mounted on the carriage.

The ink cartridge 20*a* is attached to the carriage 10. This state is described with reference to FIG. 6 and FIG. 7. FIG. 6 shows a state immediately prior to the ink cartridge 20*a* being mounted on the carriage 10. FIG. 7 shows a state after the ink cartridge 20*a* has been mounted on the carriage 10. In FIGS. 6 and 7, the ink jet head 12 fixed to the lower face of the carriage 10 is not shown.

First, the configuration of an upper part (i.e. a part that makes contact with the ink cartridge 20*a*) of the carriage 10 will be described. The carriage 10 has a carriage case 160. A hole 160*a* is formed in a central part of the carriage case 160. A member 162 is fixed to an inner peripheral wall of the hole 160*a*, this member 162 protruding upwards beyond an upper face of the carriage case 160. A connecting member 164 fits, in a manner allowing sliding in an up-down direction, with an inner peripheral wall of the member 162. An edge 164*a* of an upper face of the connecting member 164 protrudes upwards. A member 166 is disposed at a lower side of the connecting member 164. The member 166 energizes the connecting member 164 upwards. The connecting member 164 is connected with a link structure 170 that is connected with a solenoid 172. The reference number 180 in the figure refers to a sensor for detecting the remaining amount of ink (an ink remaining-amount sensor). The ink remaining-amount sensor 180 has a radiation unit and a photoreceptor (not shown). The radiation unit radiates light toward the ink cartridge 20*a*. The light can pass through the inclined plane 142 (see FIG. 3) of the ink cartridge 20*a*. In the case where the ink cartridge 20*a* is filled with ink, the light that passed through the inclined plane 142 is reflected by the ink. The photoreceptor can receive the reflected light. The ink remaining-amount sensor 180 detects whether the photoreceptor receives the reflected light when the radiation unit radiates the light. In the case where the photoreceptor receives the reflected light, the ink cartridge 20*a* is filled with ink. In the case where the photoreceptor doesn't receive the reflected light, the amount of remaining ink is very small. The ink remaining-amount sensor 180 outputs a signal when the photoreceptor doesn't receive the reflected light. The signal that has been output is received by a controller 200 (shown in FIG. 11. To be described).

In the state shown in FIG. 6, the solenoid 172 is ON. In this state, the link structure 170 pushes the connecting member 164 downwards. The connecting member 164 opposes the energizing force of the energizing member 166, and is maintained in a downwards position. In the state shown in FIG. 7 the solenoid 172 is OFF. In this state, the link structure 170 does not apply force to the connecting member 164. The connecting member 164 is lifted to an upwards position by the energizing force of the energizing member 166.

The ink cartridge 20*a* is fixed in a manner such that a guide (not shown) prevents its movement upwards or downwards. As a result, the ink cartridge 20*a* does not move upwards even when the connecting member 164 is lifted upwards.

The ink cartridge 20*a* is maintained in a predetermined position (a second position P2: to be described) before the ink cartridge 20*a* is attached to the carriage 10. The shutter 136 is closed when the ink cartridge 20*a* is in the second position P2 (see FIG. 5). The ink cartridge 20*a* is delivered from the second position P2 to a position facing the carriage 10. That is, the ink cartridge 20*a* moves towards the left. At this juncture, the shutter 136, which is closed, makes contact with an upper edge of the member 162 of the carriage 10. When the ink cartridge 20*a* moves further towards the left, the member 162 pushes the shutter 136 towards the right, thus opening the shutter 136. The state in which the member 162 is making contact with the shutter 136 is shown clearly in FIG. 6.

In the state shown in FIG. 6, the shutter 136 is open. In this state, the ink of the ink cartridge 20*a* spills from the through hole 126*d*. As a result, when the state shown in FIG. 6 is reached, the solenoid 172 is immediately switched from ON to OFF. Thereupon, the connecting member 164 moves upwards, and an upper end 164*a* of the connecting member 164 fits with the groove 126*e* of the ink cartridge 20*a*. This state is shown in FIG. 7. The ink cartridge 20*a* is thus connected with the carriage 10. When the ink ridge 20*a* is in a connected state with the carriage 10, the ink jet head 12 can use the ink from the ink cartridge 20*a* through the through hole 126*d*.

Figure 8:
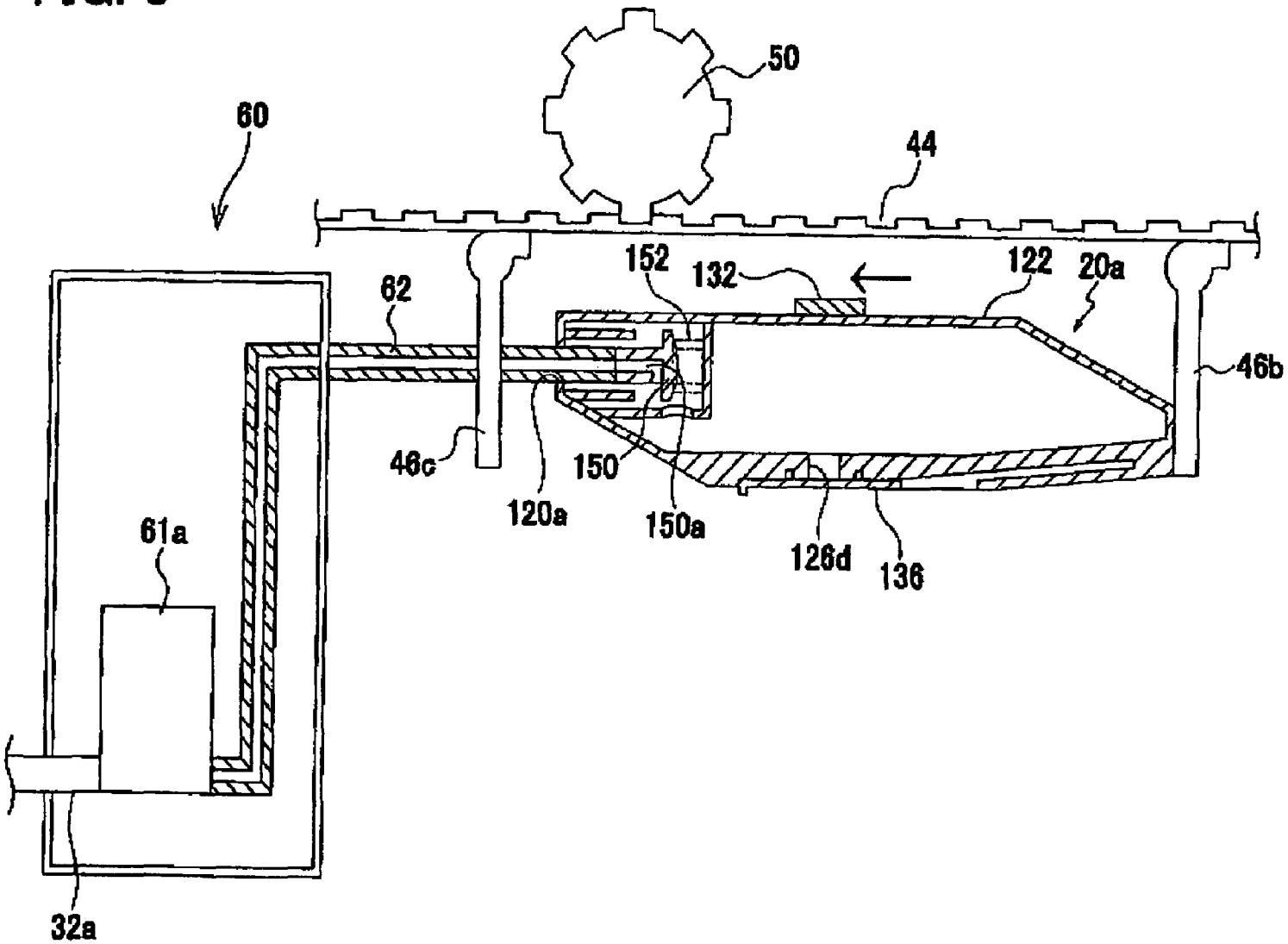
FIG. 8 shows a state where an ink replenishment device is replenishing the ink cartridge with ink.

Next, the configuration of the exchanging device 36 will be described. The exchanging device 36 is provided with the transferring device 40 and the ink replenishment device 60, etc. The configuration of the ink replenishment device 60 will be described with reference to FIG. 8. The ink replenishment device 60 has four pumps 61*a* to 61*d*. In FIG. 8, only the pump 61*a* is shown. However, the four pumps 61*a* to 61*d* are shown in FIG. 1. The tube 32*a* is connected with the pump 61*a*. The tube 32 extends from the ink tank 30*a*. Similarly, the tubes 32*b* to 32*d* are connected with the pumps 61*b* to 61*d* (see FIG. 1).

One end of a supply needle 62 is connected with the pump 61*a*. In FIG. 8, the other end of the supply needle 62 is inserted into the replenishment hole 120*a* of the ink cartridge 20*a*. When the ink cartridge 20*a* moves to the left, the supply needle 62 enters the replenishment hole 120*a* and pushes the cap 150 towards the right. When the cap 150 moves towards the right against the energizing force of the energizing member 152, the cap 150 opens. The pump 61*a* is now driven. The ink that has been pressurized by the pump 61*a* is supplied into the ink cartridge 20*a* via the supply needle 62 and the hole 150*a* of the cap 150.

Similarly, supply needles (not shown) are connected with the pumps 61*b* to 61*d*. The ink cartridges 20*b* to 20*d* (22*b* to 22*d*) are each connected with respective supply needles.

Figure 9:
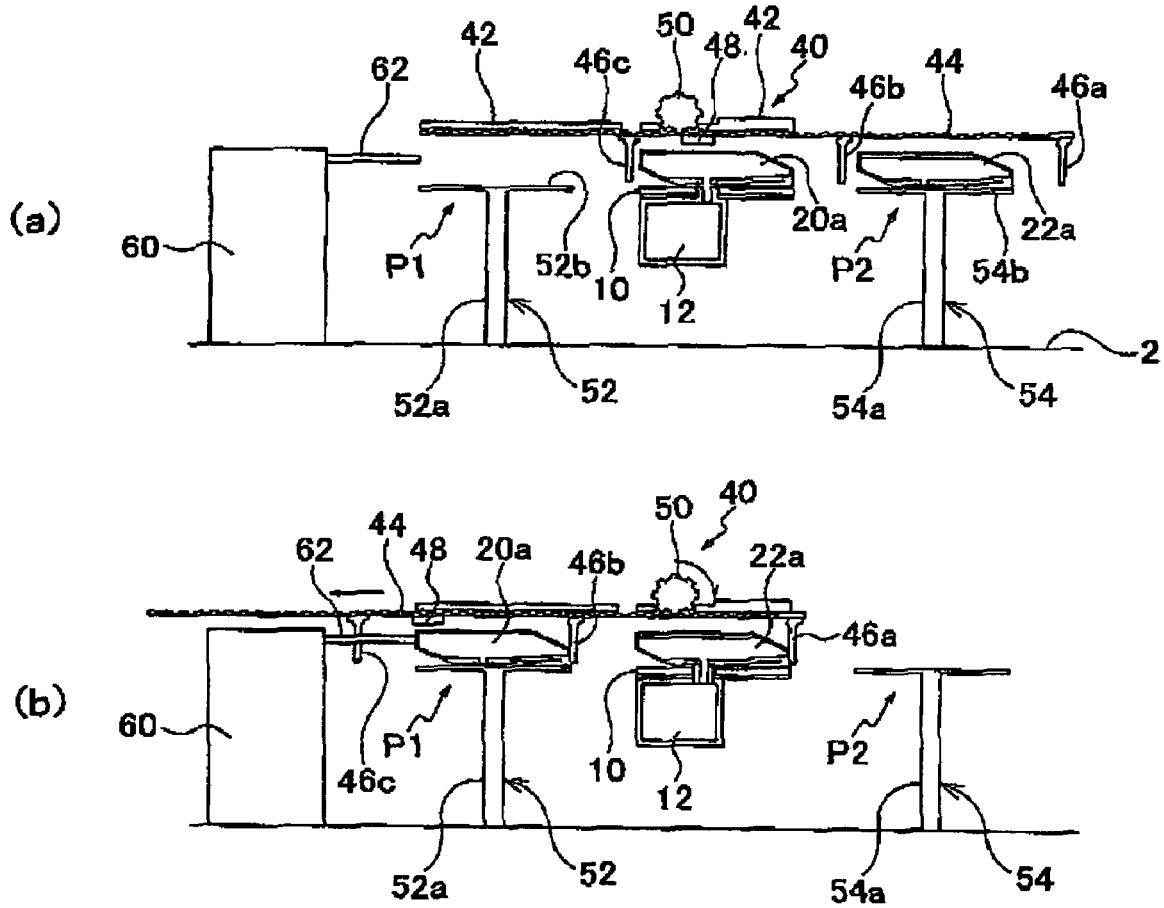
FIG. 9(*a*) shows a state immediately prior to the ink cartridge being exchanged.

Next, the configuration of the transferring device 40 will be described with reference to FIG. 9(*a*). FIG. 9(*a*) shows the entire configuration of the transferring device 40. FIG. 9(*b*) is a figure showing the ink cartridges 20*a* and 22*a* after they have been transferred from the state in FIG. 9(*a*). The state shown in FIG. 9(*b*) will be described later. Here, mechanisms for transferring the ink cartridges 20*a* and 22*a* are described. The transferring device 40 has four of these mechanisms. These mechanisms are for transferring the ink cartridges 20*a*, etc. for each color of ink.

The transferring device 40 has a guide 42, a rack member 44, contact members 46*a* to 46*c*, an electromagnet 48, a pinion shaft 50, a first support member 52, a second support member 54, etc. The guide 42 supports the rack member 44 in a manner allowing sliding. The rack member 44 extends in a left-right direction. Teeth are formed on an upper face of the rack member 44, these teeth engaging with the pinion shaft 50 (to be described). The three contact members 46*a* to 46*c* are connected perpendicularly with the rack member 44, and are aligned at approximately equal intervals. A hole (not shown) is formed in the contact member 46*c* at the leftmost side. This hole is formed in a position corresponding to the position of the supply needle 62. The hole prevents the contact member 46*c* from making contact with the supply needle 62 when this contact member 46*c* has moved towards the left. The electromagnet 48 is fixed to a lower face of the rack member 44, and is disposed between the leftmost contact member 46*c* and the central contact member 46*b*. The pinion shaft 50 is supported by the guide 42 in a manner allowing its rotation. The pinion shaft 50 is connected with an exchanging motor 56 via a pulley 58 (see FIG. 1).

The first support member 52 is fixed to the base of the casing 2 in the vicinity of the ink replenishment device 60. The first support member 52 has a pillar 52*a* and a stand 52*b* fixed to an upper end of the pillar 52*a*. The first support member 52 can support the ink cartridge 20*a* (or 22*a*) by means of the stand 52*b*. The second support member 54 is fixed to the base of the casing 2 to the right of the first support member 52. The second support member 54 is also provided with a pillar 54*a* and a stand 54*b*. The height of the stand 54*b* of the second support member 54 can be adjusted. The mechanism for adjusting height has not been shown, but the height can be adjusted by using, for example, a solenoid 230 (shown in FIG. 11). The carriage 10 can be moved in a direction perpendicular to the face of the page in FIG. 9 within the range between the first support member 52 and the second support member 54. When the carriage 10 is in the position shown by the broken line in FIG. 1, the carriage 10 is in the position of FIG. 9(*a*). Below, the position of the first support member 52 will be termed the first position P1 and the position of the second support member 54 will be termed the second position P2.

The manner in which the transferring device 40 transfers the ink cartridges 20*a* and 22*b* will be described in detail below.

Next, the configuration for controlling the printer 1 will be described. FIG. 11 is a block figure showing a control configuration of the printer 1. The controller 200 controls the operation of the printer 1. The controller 200 is a microcomputer that has a CPU 202, a ROM 204, a RAM 206, and an EEPROM 208. The CPU 202 controls each of the devices 210, etc. on the basis of control programs stored in the ROM 204. The RAM 206 temporarily stores data used while the CPU 202 is executing processes. The EEPROM 208 is a memory that stores programs, data, etc.

The ink remaining-amount sensor 180 is connected with the controller 200. The ink remaining-amount sensor 180 outputs a signal when the amount of ink remaining in the ink cartridge 20*a* etc. mounted on the carriage 10 is reduced to below a predetermined amount. The controller 200 can detect, from the signal that has been input, that the amount of ink is low in the ink cartridge 20*a*, etc. Only one ink remaining-amount sensor 180 is shown in FIG. 11. However, there are actually four ink remaining-amount sensors 180 mounted on the carriage 10. The controller 200 can detect the amount of remaining ink in each of the four ink cartridges 20*a*, etc. supported by the carriage 10.

The controller 200 is connected with driving circuits 210 to 220. The controller 200 outputs control signals to the driving circuits 210 to 220. The driving circuit 210 drives the paper feeding motor 240 based on the signals output from the controller 200. The feeding roller 80 (see FIG. 2) thus rotates. The driving circuit 212 drives the paper transportation motor 242 based on the signals output from the controller 200. The resist roller 88 and the discharge roller 92 (see FIG. 2) thus rotate. The driving circuit 214 drives the carriage motor 244 based on the signals output from the controller 200. The carriage 10 thus moves along the guide rail 4 and the guide shaft 5 (see FIGS. 1 and 2). The driving circuit 216 drives the ink jet head 12 based on the signals output from the controller 200. Ink is thus discharged from the ink jet head 12. The driving circuit 218 drives the exchanging motor 56 based on the signals output from the controller 200. When the exchanging motor 56 is driven, the rack member 44 (see FIG. 9. etc.) moves along the guide 42. The driving circuit 220 drives the ink pumps 61*a* to 61*d* based on the signals output from the controller 200. The ink cartridge 20*a*, etc. is thus replenished with ink from the ink tank 30*a*, etc.

The controller 200 controls ON/OFF of the electromagnet 48. Furthermore, the controller 200 moves the second support member 54 upwards or downwards by controlling the solenoid 230. The controller 200 controls the solenoid 172, thus moving the connecting member 164 upwards or downwards.

The controller 200 is connected with a PC 232. Printing data output from the PC 232 is input to the controller 200. The printing operation is then executed on the basis of the printing data that has been input. Specifically, the printing data that has been output from the PC 232 is stored temporarily in the RAM 206 by the CPU 202. The CPU 202 produces control signals for driving the devices 240, 242, 244, 12, etc. in accordance with the control program stored in the ROM 204.

An ink cartridge exchanging action executed by the controller 200 will be described in detail immediately below.

The manner in which the ink cartridge 20*a* mounted in the carriage 10 is exchanged will be described with reference to FIGS. 9 and 10. The ink cartridge exchanging action is executed by the controller 200. Below, the manner is described for exchanging the ink cartridge 20*a* (22*a*) for black ink. The same action is executed for the other colors of ink.

When the signal output from the ink remaining-amount sensor 180 is input to the controller 200, the carriage 10 is moved to a position between the fist support member 52 and the second support member 54. That is, the carriage 10 is moved to the position shown in FIG. 9(*a*) (the position shown by the broken line in FIG. 1). In the state shown in FIG. 9(*a*), the ink cartridge 22*a* is in the second position P2. An adequate amount of ink is stored in the ink cartridge 22*a*.

When the state shown in FIG. 9(*a*) is reached, the controller 200 switches the solenoid 172 (see FIG. 6) from OFF to ON. The state thus changes from the state shown in FIG. 7 to the state shown in FIG. 6. The connecting member 164 is released from its engagement with the groove 126*e* of the ink cartridge 20*a*.

Next, the controller 200 causes the pinion shaft 50 to rotate in a clockwise direction. The rack member 44 thus moves towards the left. When the rack member 44 moves towards the left, the contact member 46*b* makes contact with the ink cartridge 20*a* mounted in the carriage 10. Simultaneously, the contact member 46*a* makes contact with the ink cartridge 22*a* that is in the second position P2. When the rack member 44 moves finder towards the left, the contact member 46*b* pushes the ink cartridge 20*a* towards the left. The ink cartridge 20*a* is thus removed from the carriage 10. The ink cartridge 20*a* is pushed by the contact member 46*b* and is thus transferred to the first position P1. That is, the state shown in FIG. 9(*b*) is reached. In FIG. 9, etc. there appears to be a large space between the first support member 52 and the carriage 10. However, the actual space is not that large. As a result, the space does not impede the transfer of the ink cartridge 20*a*. In the present embodiment, the electromagnet 48 is fixed to the rack member 44. The electromagnet 48 may equally well be used to transfer the ink cartridge 20*a* from the carriage 10 to the first position P1 by causing the rack member 44 to move while the electromagnet 48 is attracting the ink cartridge 20*a*. In this case, the contact member 46*b* is not required. When the ink cartridge 20*a* has been moved to the first position P1, the supply needle 62 is inserted into the replenishment hole 120*a* of the ink cartridge 20*a*.

While the ink cartridge 20*a* is being transferred to the first position P1, the ink cartridge 22*a* is also pushed towards the left by the contact member 46*a*. The ink cartridge 22*a* is thus transferred from the second position P2 to the carriage 10. There appears to be a large space between the second support member 54 and the carriage 10. However, the actual space is not that large. As a result, the space does not impede the transfer of the ink cartridge 22*a*. Furthermore, an electromagnet may equally well be disposed between the contact member 46*a* and the contact member 46*b*, and this electromagnet may transfer the ink cartridge 22*a* from the second position P2 to the carriage 10. When the ink cartridge 22*a* has been transferred to the carriage 10, the controller 200 switches the solenoid 172 (see FIG. 6, etc.) from ON to OFF. The state thus changes from the state shown in FIG. 6 to the state shown in FIG. 7. The connecting member 164 is engaged with the ink cartridge 20*a*.

When the state shown in FIG. 9(*b*) is reached, the ink cartridge 22*a* is mounted in the carriage 10. The ink cartridge 22*a* contains ink, and the printing operation can be executed using the ink cartridge 22*a*.

The controller 200 replenishes the ink in the ink cartridge 20*a*. That is, the pump 61*a* (see FIG. 1, etc.) is driven. The black ink stored within the ink tank 30*a* is delivered to the ink cartridge 20*a* via the tube 32*a*, the pump 61*a*, and the supply needle 62. The ink cartridge 20*a* is thus replenished with the black ink. As described above, the carriage 10 can be moved and the printing operation cam be executed while the ink in the ink cartridge 20*a* is being replenished.

When the replenishment of ink in the ink cartridge 20*a* has been completed, the ink cartridge 20*a* is transferred from the first position P1 to the second position P2. This will be described with reference to FIG. 10.

Figure 10:
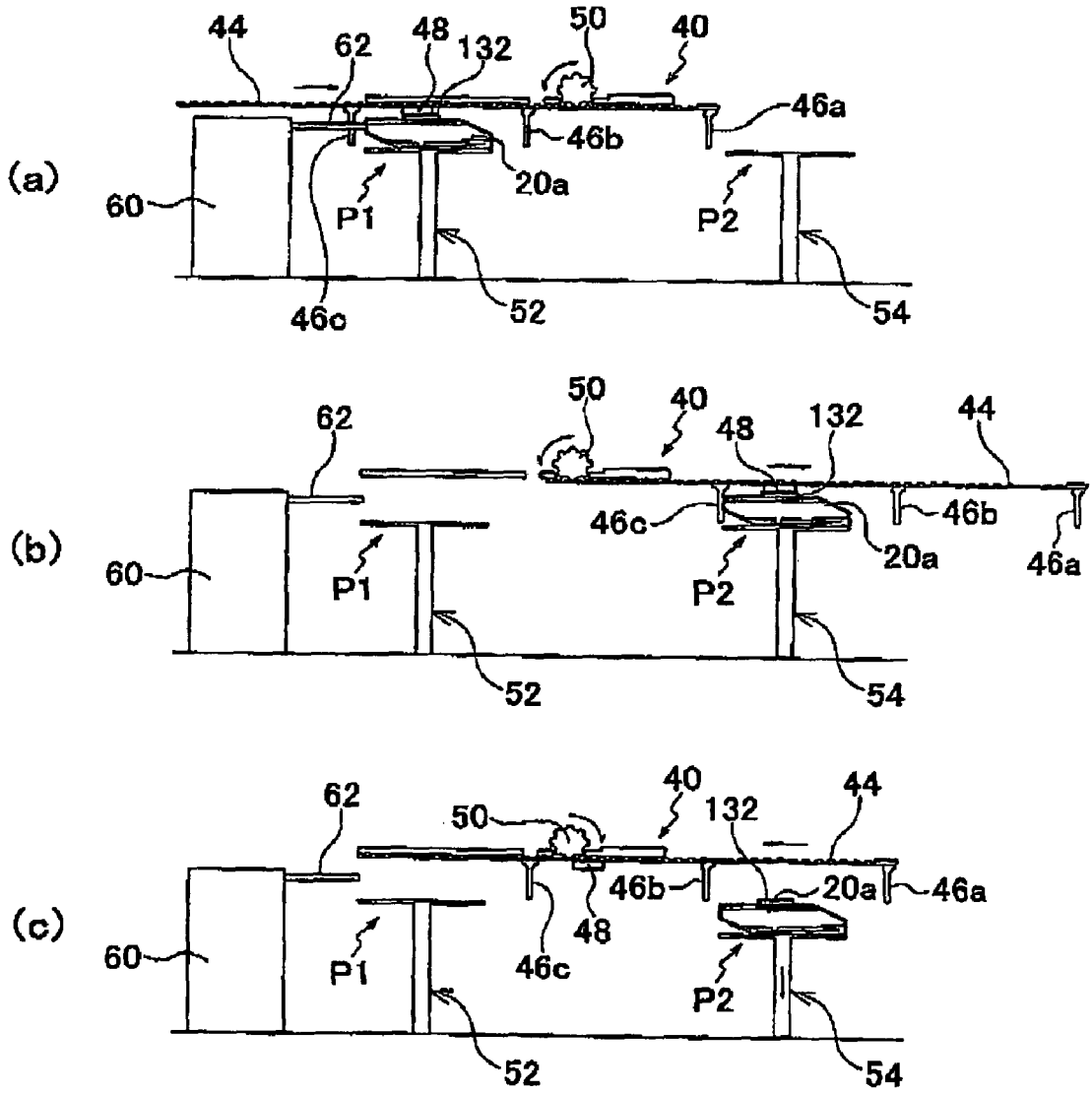
FIG. 10(*a*) shows a state where the carriage has been moved after the ink cartridge has been exchanged.

FIG. 10(*a*) shows a state after the carriage 10 has been moved out from a position between the first position P1 and the second position P2 for the printing operation. The controller 200 turns the electromagnet 48 ON. The magnetic force of the electromagnet 48 attracts the metal plate 132 (see FIG. 3, etc.) of the ink cartridge 20*a*, and the ink cartridge 20*a* is thus connected with the rack member 44. The controller 200 causes the pinion shaft 50 to rotate in a counterclockwise direction while maintaining the electromagnet 48 in the ON state. The rack member 44 moves towards the right, and the ink cartridge 20*a* moves therewith towards the right. The pinion shaft 50 rotates until the ink cartridge 20*a* reaches the second position P2 (the second support member 54). When the ink cartridge 20*a* has reached the second position P2, the controller 200 stops the rotation of the pinion shaft 50 and turns OFF the electromagnet 48. The ink cartridge 20*a* is thus maintained by the second support member 54 (see FIG. 10(*b*)). Since the electromagnet 48 is used in the present embodiment, the contact member 46*c* does not push the ink cartridge 20*a*. However, if there were no space between the first support member 52 and the second support member 54, the ink cartridge 20*a* could be transferred from the first position P1 to the second position P2 by having the contact member 46*c* push the ink cartridge 20*a*. In this case, the electromagnet 48 would no longer be required.

When the state shown in FIG. 10(*b*) has been reached, the controller 200 drives the solenoid 230 (see FIG. 11) to lower the second support member 54. FIG. 10(*c*) shows a state where the second support member 54 has been lowered. When the second support member 54 has been lowered, the controller 200 causes the pinion shaft 50 to rotate in a clockwise direction, thus moving the rack member 44 towards the left. Since the second support member 54 has been lowered, the contact member 46*b* does not make contact with the ink cartridge 20*a* that is in the second position P2. When the ink cartridge 20*a* is positioned between the contact member 46*a* and the contact member 46*b* (the state shown in FIG. 10(*c*)), the movement of the rack member 44 stops. Then, the controller 200 moves the second support member 54 upwards.

The ink cartridge exchanging action is completed by executing the aforementioned actions consecutively. When the ink runs out in the ink cartridge 22*a* mounted in the carriage 10, the ink cartridge 22*a* is removed from the carriage 10, and the ink cartridge 20*a* is mounted in the carriage 10. That is, the ink cartridge 20*a* and the ink cartridge 22*a* are mounted alternately on the carriage 10. In the printer 1, the ink cartridge 20*a* and the ink cartridge 22*a* are used alternately.

With the printer 1 of the present embodiment, the ink cartridges 20*a* to 20*d* and 22*a* to 22*d* are provided as a pair for each color. For example, if the ink runs out in the ink cartridge 20*a*, the ink cartridge 20*a* can be replaced by the ink cartridge 22*a*. The printing operation can be executed using the ink cartridge 22*a* while the ink in the ink cartridge 20*a* is being replenished. With the printer 1, the printing operation does not need to be stopped for a long period in order for the ink to be replenished.

With the printer 1, the action of transferring the ink cartridge 20*a*, etc. from the carriage 10 to the fast position P1 is executed simultaneously with the action of transferring the ink cartridge 20*a*, etc. from the second position P2 to the carriage 10. The action of exchanging the ink cartridge 20*a*, etc. is executed while the carriage 10 is positioned between the first position P1 and the second position P2. The time for exchanging the ink cartridges 20*a* and 22*a*, etc. is short.

Furthermore, the ink cartridges 20*a*, etc. have the inclined plane 142 formed between the anterior face 120 and the base face 126, and the inclined plane 140 formed between the posterior face 124 and the base face 126. As a result, the ink cartridges 20*a*, etc. can move smoothly.

Moreover, if the printer 1 of the present embodiment is used, the ink cartridges 20*a*, etc. are used repeatedly, and it is consequently not necessary to discard the ink cartridges 20*a*, etc. The printer 1 is thus environmentally friendly.

Variants of the aforementioned embodiment will now be given.

Figure 12:
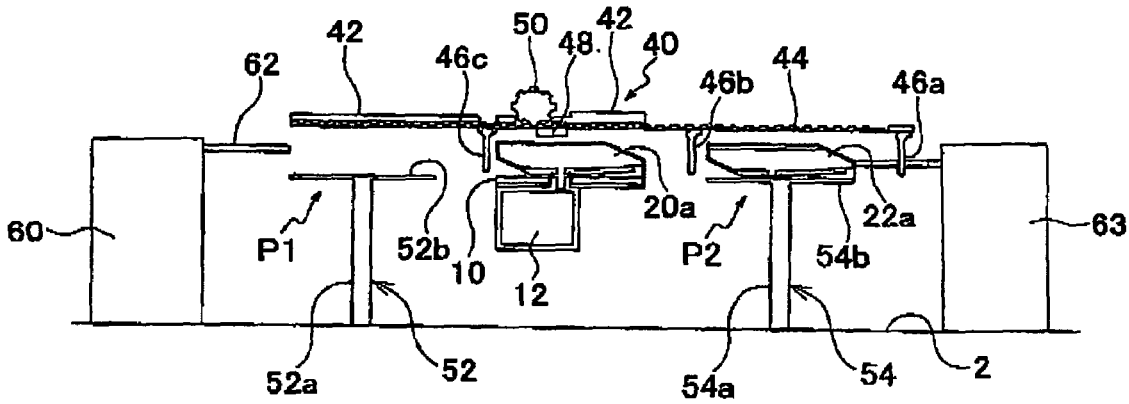
FIG. 12 shows a figure for describing a variant of the tint embodiment.

(1) It is also possible to replenish the ink at both the first position P1 and the second position P2. This variant will be described with reference to FIG. 12. As shown in FIG. 12, the ink replenishment device 60 can replenish the ink of the ink cartridge positioned at the first position P1. An ink replenishment device 63 can replenish the ink of the ink cartridge positioned at the second position P2. If, for example, the ink runs out in the ink cartridge 20*a*, the ink cartridge 20*a* is transferred to a position (for example, the first position P1) in which the ink cartridge 22*a* is not located. Then the ink of the ink cartridge positioned at the first position P1 is replenished. The ink cartridge 22*a* is transferred from the second position P2 to the carriage 10. The printing operation can be executed using the ink from the ink cartridge 22*a*. When the ink runs out in the ink cartridge 22*a*, the ink cartridge 22*a* is transferred from the carriage 10 to the second position P2. Simultaneously, the ink cartridge 20*a* is transferred from the first position P1 to the carriage 10. A hole for replenishment is formed in a face of the ink cartridge 22*a* at the side thereof facing the ink-replenishment device 63. The ink in the ink cartridge 22*a* is replenished from the ink replenishment device 63.

With this variant, it is possible to reduce the distance across which the ink ridges 20*a*, etc. must be transferred.

(2) The ink cartridges 20*a*, etc. may equally well be provided with inclined planes other than the inclined planes 140 and 142 in the aforementioned representative embodiment. For example, an inclined plane may be formed between he upper face 122 and the side faces 128 and 130. An inclined plane may be formed between the base face 126 and the side faces 128 and 130. The inclined planes allow the ink cartridges 20*a*, etc. to be moved smoothly.

(3) In the ink cartridges 20*a*, etc. of the present representative embodiment, instead of the inclined plane 142, a curving plane may be chamfered between the anterior face 120 and the base face 126. In this case, the same effects can be obtained as when the inclined plane 142 is formed. Further, it is equally possible to chamfer a plane between the base face 126 and the side faces 128 and 130.

(4) In the printer 1 of the present embodiment, the ink is replenished after the ink cartridge 20*a*, etc. has been transferred from the carriage 10 to the first position P1. Simultaneously, the ink cartridge 20*a*, etc. is transferred from the second position P2 to the carriage 10. However, it is equally possible that the ink cartridge 20*a*, etc. is transferred from the carriage 10 to the second position P2. Simultaneously, the ink cartridge 20*a*, etc. may be transferred from the first position P1 to the carriage 10. In this case, the ink cartridge 20*a*, etc. that has been transferred to the second position P2 is next transferred to the first position P1. The ink is replenished in the ink cartridge 20*a*, etc. that has been transferred to the first position P1. The ink cartridge 20*a*, etc. that has been replenished waits in the first position P1.

(5) It is equally possible that the action for transferring the ink cartridge 20*a*, etc. from the carriage 10 to the first position P1, and the action for transferring the ink cartridge 20*a*, etc. from the second position P2 to the carriage 10, are executed at separate times. However, in this case, a separate rack member 44 and exchanging motor 56 must be provided for the respective transferring actions. As a result, the configuration for the first representative embodiment is simpler.

(6) In the first embodiment described above, a region of movement of the carriage 10 is formed between the first position P1 and the second position P2. That is, the first position P1 and the second position P2 are aligned in a direction perpendicular to the direction of movement of the carriage 10. However, the first position P1 and the second position P2 may equally well be aligned in the direction of movement of the carriage 10.

Second Embodiment

Next, an ink jet printer 301 of a second embodiment will be described with reference to FIG. 13. The printer 301 differs from the first embodiment in the configuration of ink cartridge exchanging devices 336 and 338, and of an ink cartridge 320*a*. The points differing from the first embodiment will be described in detail in the present embodiment.

Figure 13:
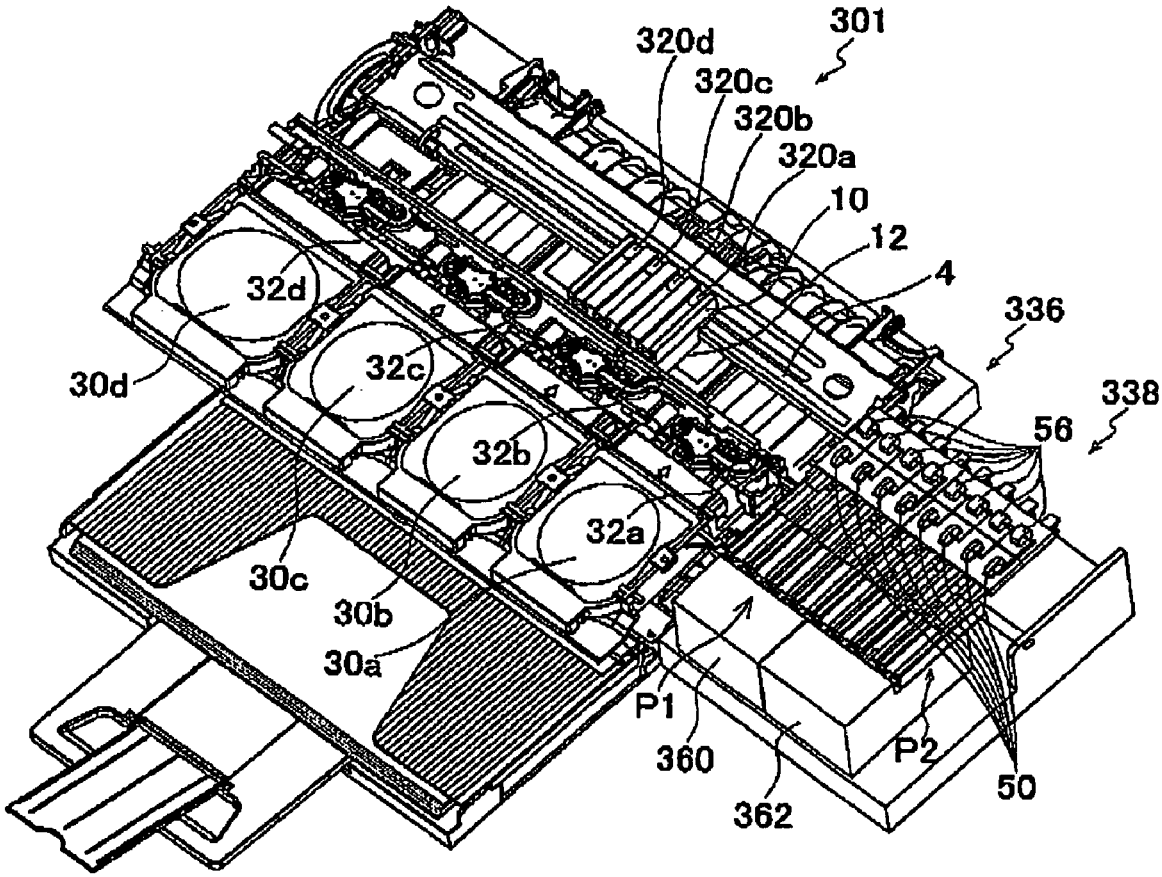
FIG. 13 shows a perspective view of an ink jet printer of a second embodiment.

FIG. 13 shows a perspective view of the printer 301 of the second embodiment. The printer 301 is provided with the two exchanging devices 336 and 338. The exchanging device 336 has an ink replenishment device 360, and the exchanging device 338 has an ink replenishment device 362. The ink replenishment device 360 is connected with the ink tanks 30*a* to 30*d*. The ink replenishment device 362 is also connected with the ink tanks 30*a* to 30*d*.

Neither of the exchanging devices 336 and 338 has the second support member 54 (see FIG. 9, etc.) of the first embodiment. Both the exchanging devices 336 and 338 have the first support member 52 (see FIG. 9, etc.). In the present embodiment, the position of the first support member 52 of the exchanging device 336 is termed the first position P1. The position of the first support member 52 of the exchanging device 338 is termed the second position P2. In the present embodiment, the first position P1 and the second position P2 are aligned in the same direction as the direction of movement of the carriage 10.

In the present embodiment, a pair of cartridges 320*a*, etc. is provided for each color of ink. Ink cartridges 320*a* and 322*a* are provided for black ink. The manner of exchanging the ink cartridges 320*a* and 322*a* is described below. When, for example, the ink runs out in the ink cartridge 320*a*, the carriage 10 is moved to the exchanging device 336 (which is not supporting the ink cartridge 322*a*). In this description, it is considered that the ink cartridge 322*a* is being supported by the exchanging device 338. That is, it is considered that the ink cartridge 322*a* is not present in the first position P1 (see FIG. 9, etc.) of the exchanging device 336. When the carriage 10 is moved to the exchanging device 336, the ink cartridge 320*a* is transferred from the carriage 10 to the first position P1 of the exchanging device 336. This transfer action can be executed using the nick member 44 and the pinion shaft 50, in the same manner as in the first embodiment. The ink replenishment device 360 replenishes the ink of the ink cartridge 320*a* that has been transferred to the first position P1 of the exchanging device 336.

When the ink cartridge 320*a* is transferred to the first position P1 of the exchanging device 336, the cage 10 is moved to the other exchanging device 338. Thereupon, the ink cartridge 322*a*, that is present in the second position P2 of the exchanging device 338, is transferred to the carriage 10. The ink cartridge 322*a* is thus mounted in the carriage 10. The printing operation can be executed using the ink cartridge 322*a* while the ink in the ink cartridge 320*a* is being replenished.

When the ink runs out in the ink cartridge 322*a*, the carriage 10 is moved to the exchanging device 338. When the carriage 10 is moved to the exchanging device 338, the ink cartridge 322*a* is transferred from the carriage 10 to the second position P2 of the exchanging device 338. The ink replenishment device 362 of the exchanging device 338 replenishes the ink of the ink cartridge 322*a*. When the ink cartridge 322*a* is transferred to the second position P2 of the exchanging device 338, the carriage 10 is moved to the other exchanging device 336. Thereupon, the ink cartridge 320*a*, in which the ink replenishment has been completed, is transferred from the first position P1 of the exchanging device 336 to the carriage 10. The ink cartridge 320*a* is thus mounted in the carriage 10. The printing operation can be executed using the ink cartridge 320*a* while the ink in the ink cartridge 322*a* is being replenished.

The RAM 206 (see FIG. 11) of the controller 200 can store the information as to which of the exchanging devices 336 and 338 is maintaining the ink cartridge 320*a*, etc., wherein the replenishment of the ink has been completed.

Figure 14:
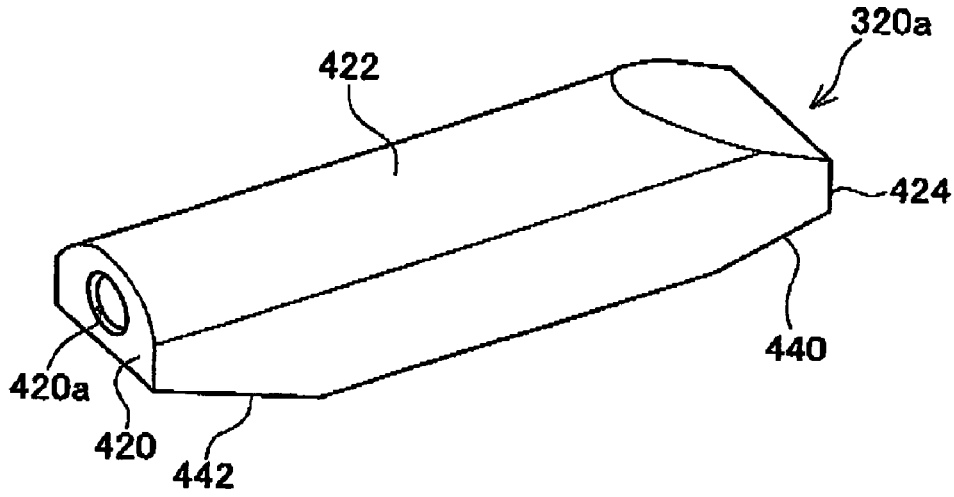
FIG. 14 shows a perspective view of an ink cartridge viewed obliquely from above.
Figure 15:
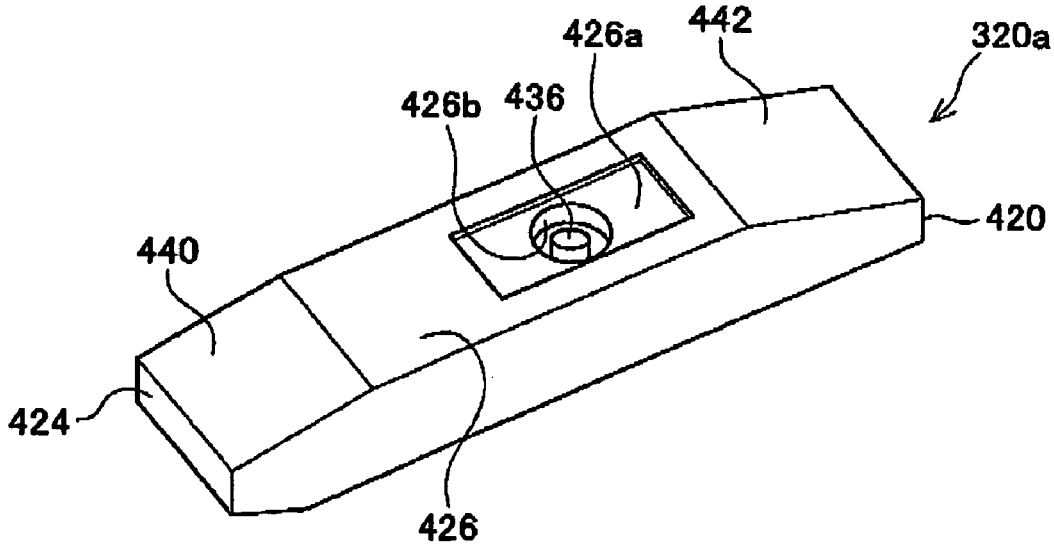
FIG. 15 shows a perspective view of the ink cartridge viewed obliquely from below.
Figure 16:
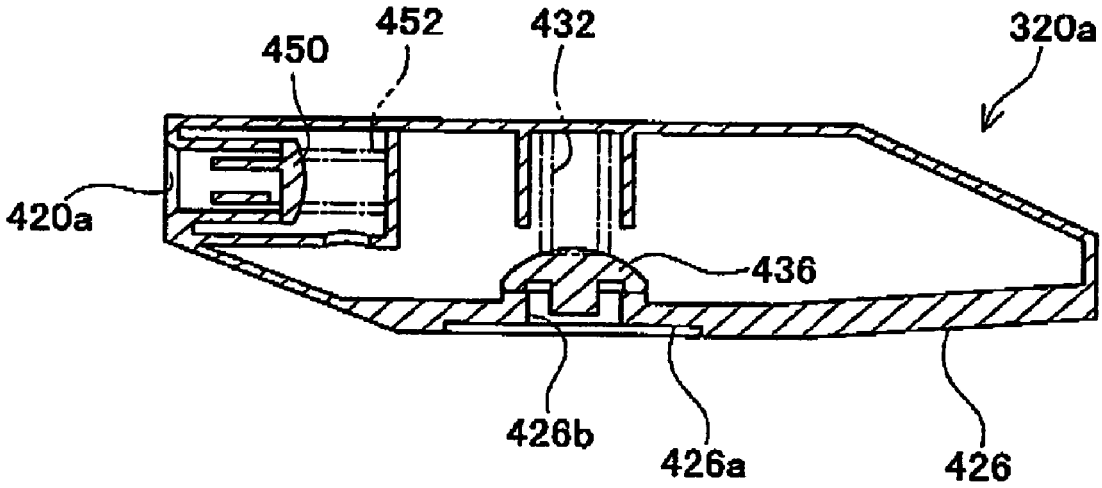
FIG. 16 shows a longitudinal sectional view of the ink cartridge.

Next, the ink cartridge 320*a* of the present embodiment will be described with reference to FIGS. 14 to 16. FIG. 14 shows a perspective view of the ink cartridge 320*a* viewed obliquely from above. FIG. 15 shows a perspective view of the ink cartridge 320*a* viewed obliquely from below. FIG. 16 shows a longitudinal sectional view of the ink cartridge 320*a*.

The ink cartridge 320*a* does not have a metal plate 132 (see FIG. 3, etc.). The ink cartridge 320*a* has an inclined plane 440 formed between a base face 426 and a posterior face 424. Further, an inclined plane 442 is formed between an anterior face 420 and a base face 426.

A groove 426*a* that has a base is formed in the base face 426 of the ink cartridge 320*a*. A hole 426*b* is formed in a base face of the groove 426*a*. A cap 436 is inserted into the hole 426*b*. As shown in FIG. 16, the cap 436 is energized downwards by an energizing member 432. As long as upwards pressure is not applied to the cap 436, this cap 436 closes the hole 426*b*.

Figure 17:
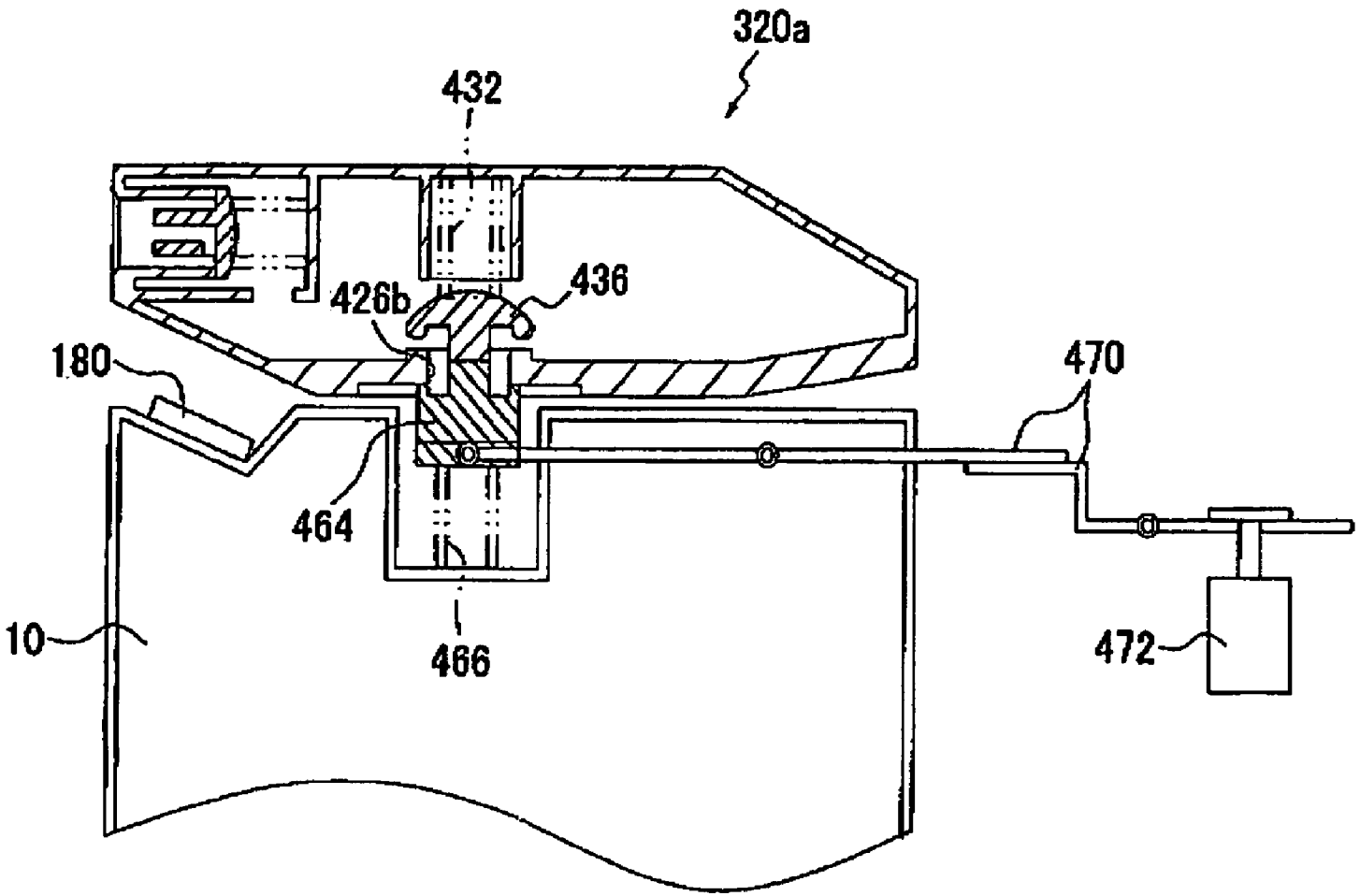
FIG. 17 shows a state where the ink cartridge has been mounted on a carriage.
Figure 18:
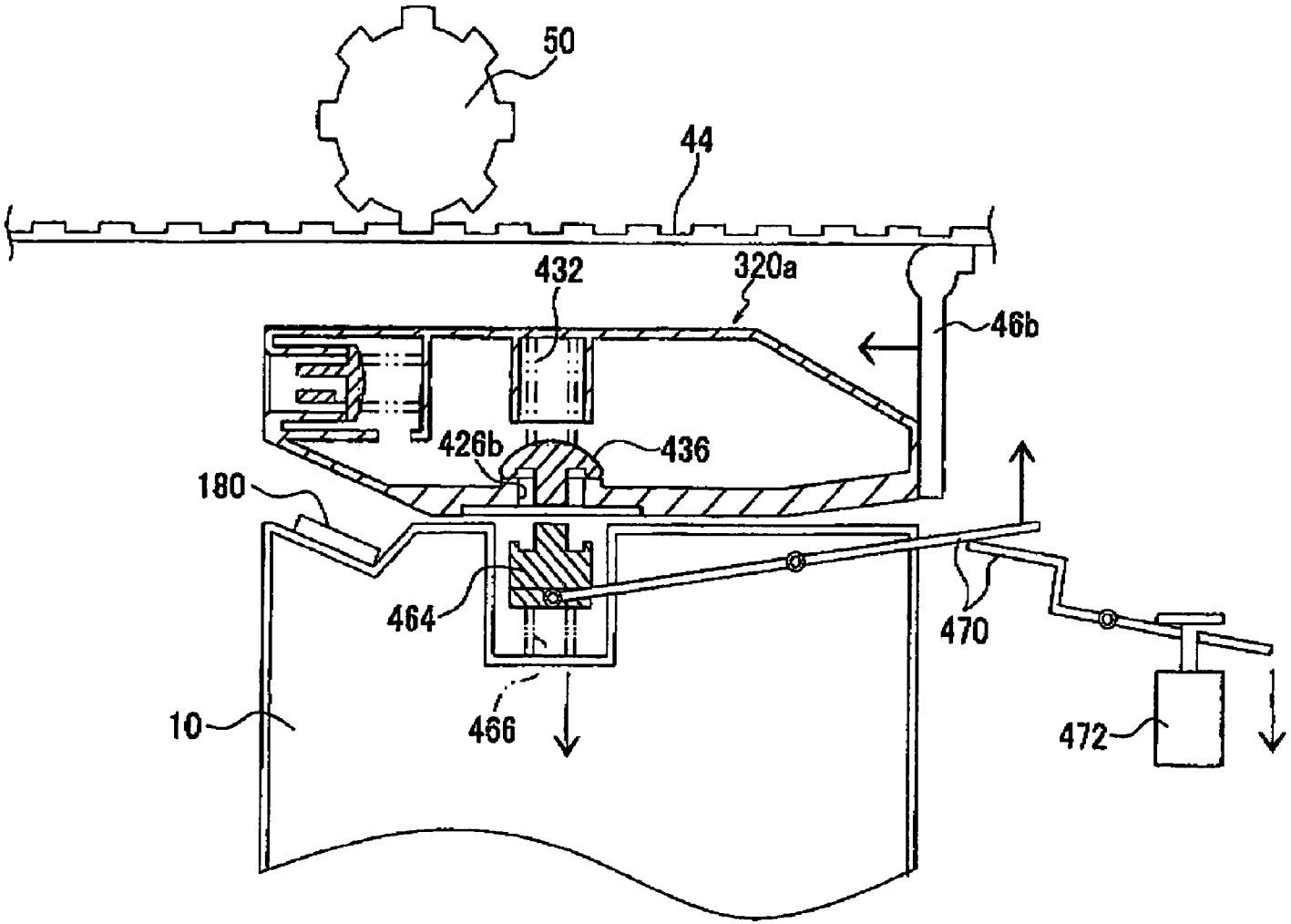
FIG. 18 shows a state where the ink cartridge has been removed from the carriage.

FIG. 17 shows a state where the ink cartridge 320*a* has been attached to the carriage 10. FIG. 18 shows a state where the ink cartridge 320*a* is removed from the carriage 10.

When the ink cartridge 320*a* is attached to the carriage 10, a solenoid 472 is in an OFF state. At this juncture, a connecting member 464 is maintained upwards by the energizing force of a spring 466. The connecting member 464 pushes the cap 436, thus opening the hole 426*b*. In is state, the ink jet head 12 (see FIG. 12) can use the ink of the ink cartridge 320*a*. Further, the connecting member 464 passes through the cap 436 and thus fixes the position of the ink cartridge 320*a*. The ink cartridge 320*a* can thus be prevented from moving to the left or right.

In the case where the ink remaining-amount sensor 180 detects that the remaining amount of ink is below the predetermined amount, the CPU 202 (see FIG. 11) of the controller 200 moves the carriage 10 to the exchanging device 336 (or 338). Then, as shown in FIG. 18, the solenoid 472 is turned ON. When the solenoid 472 is turned ON, a link 470 pushes the connecting member 464 downwards. When the connecting member 464 moves downwards, the connecting member 464 separates from the ink cartridge 320*a*. The cap 436 thus closes the hole 426*b*.

In the present embodiment, the two exchanging devices 336 and 338 are provided. The exchanging devices 336 and 338 are respectively provided with the ink replenishment devices 360 and 362. Therefore, it is not necessary to move the ink cartridges 320*a*, etc. from the first position P1 to the second position P2, as is needed in the first embodiment. The distance across which the ink cartridge 320*a* must be moved is thus decreased.

Further, the positions P1 and P2, in which the ink is replenished, are aligned in the same direction as the direction of movement of the carriage 10. As a result, the exchanging devices 336 and 338 can have a smaller longitudinal width (the width in the direction perpendicular to the direction of movement of the carriage 10) than in the fist embodiment.

Variants of the second embodiment will now be given.

(1) In the second embodiment, the RAM 206 stores the information concerning which of the exchanging devices 336 and 338 is maintaining the ink cartridge 320*a*, etc., in which ink replenishment has been completed. Instead, however, a position detecting means (a mechanical sensor, an optical sensor, etc.) can be provided that determines whether the ink cartridge 320*a*, etc. is in the first position P1 or the second position P2. The controller 200 receives the results that have been detected by the detecting means, and performs control on the basis of these results.

(2) As in the first embodiment, the positions P1 and P2 may equally well be located so as to be mutually opposing with the range of movement of the carriage 10 located between the two. In this case, it is preferred that there is an ink replenishment device provided for replenishing the ink in the ink cartridge 320*a*, etc. when this is in the first position P1, and an ink replenishment device for replenishing the ink in the ink cartridge 320*a*, etc. when this is in the second position P2. In this case, it is preferred that a replenishment hole, for allowing the ink to be replenished, is also formed in the posterior face 424 of the ink cartridge 320*a*, etc. If this is done, the ink can be replenished easily.

(3) In the second embodiment, the exchanging device 336 has the ink replenishment device 360, and the exchanging device 338 has the ink replenishment device 362. However, it is equally possible that the ink replenishment device 362 is not provided. In this case, the printer 301 functions in the following manner When the ink runs out in the ink cartridge 320*a*, etc. that is mounted in the carriage 10, the carriage 10 moves to the exchanging device 336. Then, the ink cartridge 320*a* is transferred from the carriage 10 to the first position P1. The ink replenishment device 360 replenishes the ink in the ink cartridge 320*a*. The carriage 10 moves to the exchanging device 338. The ink cartridge 322*a* is located in the second position P2. This ink cartridge 322*a* is transferred from the second position P2 to the carriage 10, and the printing operation can be executed using the ink cartridge 322*a*. The ink cartridge 320*a* is transferred from the first position P1 to the second position P2. Various types of mechanical configurations can be used to perform this transportation. An electromagnet, a rack and pinion mechanism, etc., as described in the embodiments above, can be used.

What is claimed is:

1. An ink jet printer, comprising:

a carriage;

a transferring device;

a pair of ink cartridges storing ink of a same color, wherein one of the ink cartridge, by means of the transferring device, is alternately supported by the carriage;

an ink jet head supported by the carriage, the ink jet head discharging ink supplied from the ink cartridge supported by the carriage;

an ink tank configured to store ink of the same color;

an ink replenishment device configured to replenish the ink cartridge not supported by the carriage with the ink from the ink tank, wherein the ink replenishment device does not replenish the ink cartridge supported by the carriage with the ink from the ink tank.

2. The ink jet printer as in claim 1, wherein the transferring device configured to transfer, in a first transferring action, the ink cartridge supported by the carriage from the carriage to a first position, and configured to transfer, in a second transferring action, the ink cartridge positioned at a second position from the second position to the carriage;

wherein the ink replenishment device is configured to replenish the ink cartridge positioned at the first position with the ink, and the transferring device is further configured to transfer, in a third transferring action, the ink cartridge which has been replenished with the ink from the first position to the second position.

3. The ink jet printer as in claim 2, wherein the carriage is configured to be positioned between the first position and the second position, the transferring device is configured to simultaneously perform the first transferring action and the second transferring action while the carriage is positioned between the first position and the second position, and the transferring device is configured to perform the third transferring action while the carriage is positioned at a position outside of a line connecting the first position and the second position.

4. The ink jet printer as in claim 2, wherein the transferring device comprises a first member configured to push the ink cartridge from the carriage to the first position during the first transferring action.

5. The ink jet printer as in claim 4, wherein the transferring device further comprises a second member configured to push the ink cartridge from the second position to the carriage during the second transferring action.

6. The ink jet printer as in claim 5, wherein the transferring device further comprises a rack member connected with the first member and the second member, and a pinion connected with the rack member.

7. The ink jet printer as in claim 2, wherein the transferring device further comprises an electromagnet, each ink cartridge comprises a magnetic body, and the electromagnet is configured to move from the first position to the second position during the third transferring action.

8. The ink jet printer as in claim 2, wherein the first position and the second position are aligned in a direction perpendicular to a direction of movement of the carriage, and the transferring device is configured to perform the first transferring action in a predetermined direction perpendicular to the direction of movement of the carriage, and is configured to perform the second transferring action in the predetermined direction.

9. The ink jet printer as in claim 2, wherein the first position and the second position are aligned in a direction parallel to a direction of movement of the carriage, and the transferring device is configured to perform the first transferring action in a predetermined direction perpendicular to the direction of movement of the carriage, and is configured to perform the second transferring action in a direction opposite to the predetermined direction.

10. The ink jet printer as in claim 1, wherein the transferring device device configured to transfer in a fourth transferring action, the ink cartridge supported by the carriage from the carriage to a second position, in a fifth transferring action, the ink cartridge positioned at a first position from the first position to the carriage, and in a sixth transferring action, the ink cartridge positioned at the second position from the second position to the first position, wherein the ink replenishment device is configured to replenish the ink in the cartridge positioned at the first position.

11. The ink jet printer as in claim 1, wherein the transferring device device configured to transfer in a seventh transferring action, the ink cartridge supported by the carriage from the carriage to a first position, in an eighth transferring action, the ink cartridge positioned at a second position from the second position to the carriage, in a ninth transferring action, the ink cartridge supported by the carriage from the carriage to the second position, and in a tenth transferring action, the ink cartridge positioned at the first position from the first position to the carriage, wherein the ink replenishment device comprises a first ink replenishment device and a second ink replenishment device, and wherein the first ink replenishment device is configured to replenish the ink in the cartridge positioned at the first position, and the second ink replenishment device is configured to replenish the ink in the ink cartridge positioned at the second position.

12. The ink jet printer as in claim 2, wherein each ink cartridge has approximately a box shape, each ink cartridge has an inclined plane between an anterior face and a lower face, and the anterior face of each ink cartridge faces a direction of movement of the ink cartridge during the first transferring action and/or the second transferring action.

13. An ink jet printer, comprising:

a carriage;

a transferring device;

a pair of ink cartridges storing ink of same color, wherein one of the ink cartridge, by means of the transferring device, is alternately supported by the carriage;

an ink jet head supported by the carriage, the ink jet head discharging ink supplied from the ink cartridge supported by the carriage;

an ink tank configured to sore ink of the same color; and an ink replenishment device configured to replenish the ink cartridge not supported by the carriage with the ink from the ink tank, wherein the ink jet head is configured to discharge the ink supplied from the ink cartridge supported by the carriage while the replenishment device replenishes the ink cartridge not supported by the carriage with the ink from the ink tank.

* * * * *